US006289781B1

(12) United States Patent
Cohen

(10) Patent No.: US 6,289,781 B1
(45) **Date of Patent: *Sep. 18, 2001**

(54) COMPOSITE ARMOR PLATES AND PANEL

(76) Inventor: Michael Cohen, Kibbutz Kfar Etzion, Mobile Post North Yehuda 90200 (IL)

( * ) Notice: Subject to any disclaimer, the term of this patent is extended or adjusted under 35 U.S.C. 154(b) by 0 days.
This patent is subject to a terminal disclaimer.

(21) Appl. No.: 09/313,681

(22) Filed: May 18, 1999

Related U.S. Application Data

(63) Continuation-in-part of application No. 09/048,628, filed on Mar. 26, 1998, now Pat. No. 6,112,635, which is a continuation-in-part of application No. 08/944,343, filed on Oct. 6, 1997, now Pat. No. 5,972,819, which is a continuation-in-part of application No. 08/704,432, filed on Aug. 26, 1996, now Pat. No. 5,763,813.

(30) Foreign Application Priority Data

May 19, 1998 (IL) ..... 124-543

(51) Int. Cl.[7] ..... F41H 5/04
(52) U.S. Cl. ..... 89/36.02; 428/911
(58) Field of Search ..... 89/36.01, 36.02; 109/82, 83, 84; 428/911

(56) References Cited

U.S. PATENT DOCUMENTS

| | | | | |
|---|---|---|---|---|
| 3,523,057 | | 8/1970 | Buck | 161/116 |
| 3,705,558 | * | 12/1972 | McDougal et al. | 109/84 |
| 4,179,979 | | 12/1979 | Cook et al. | 89/36.02 |
| 4,602,385 | | 7/1986 | Warren | 2/2 |
| 5,361,678 | | 11/1994 | Roopchand et al. | 89/36.02 |
| 5,763,813 | * | 6/1998 | Cohen et al. | 89/36.02 |
| 6,112,635 | * | 9/2000 | Cohen | 89/36.02 |

FOREIGN PATENT DOCUMENTS

| | | |
|---|---|---|
| 101437 | 9/1897 | (DE) . |
| 1578324 | 1/1970 | (DE) . |
| 39 38 741 A1 | 3/1991 | (DE) . |
| 0 499 812 A1 | 8/1992 | (EP) . |
| 2 711 782 | 5/1995 | (FR) . |
| 1081464 | 8/1967 | (GB) . |
| 1142689 | 2/1969 | (GB) . |
| 1352418 | 5/1974 | (GB) . |
| 2272272 | 5/1994 | (GB) . |

OTHER PUBLICATIONS

Plasan Sasa Plastic Products, Price Lists, Mar. 31, 1998.
Coors Porcelain Company Brochure, 1 page.
Ballistic Materials and Penetration Mechanics, Chapter 6, Roy C. Laible, pp. 135–142, 1980.
14th International Symposium on Ballistics, Quebec, Canada, The Performance of Lightweight Ceramic Faced Armours Under Ballistic Impact, Drs. C. Navarro, M.A. Martinez, R. Cortes and V. Sanchez–Galvez, pp. 573–577, Sep. 1993.
Alumina, Processing, Properties and Applications, E. Dorre & H. Hubner, pp. 278–283, 1984.
Rafael, System Concept of Applique Flexible Ceramic Armor (FCA), Technical Proposal, pp. 3–41, Jun. 1993.

* cited by examiner

*Primary Examiner*—Stephen M. Johnson
(74) *Attorney, Agent, or Firm*—Fulbright & Jaworski L.L.P.

(57) ABSTRACT

The invention provides a composite armor plate for absorbing and dissipating kinetic energy from high velocity projectiles, the plate comprising a single internal layer of pellets which are directly bound and retained in plate form by a solidified material such that the pellets are bound in a plurality of adjacent rows, characterized in that the pellets have a specific gravity of at least 2 and are made of a material selected from the group consisting of glass, sintered refractory material, ceramic material which does not contain aluminium oxide and ceramic material having an aluminium oxide content of not more than 80%, the majority of the pellets each have at least one axis of at least 3 mm length and are bound by the solidified material in the single internal layer of adjacent rows such that each of a majority of the pellets is in direct contact with at least 4 adjacent pellets in the same layer to provide mutual lateral confinement therebetween, the pellets each have a substantially regular geometric form and the solidified material and the plate are elastic.

16 Claims, 1 Drawing Sheet

COMPOSITE ARMOR PLATES AND PANEL

The present specification is a continuation-in-part U.S. Ser. No. 08/944,343, filed Oct. 6, 1997 now U.S. Pat. No. 5,972,819, as well as being a continuation-in-part of U.S. Ser. No. 09/048,628, filed Mar. 26, 1998, now U.S. Pat. No. 6,112,635, which in turn is a continuation-in-part of U.S. Ser. No. 08/704,432, filed Aug. 26, 1996 and now granted as U.S. Pat. No. 5,763,813.

The present invention relates to composite armor plates and panels. More particularly, the invention relates to an armored plate which may be worn to provide the user with lightweight ballistic protection, as well as to armored plates for providing ballistic protection for light and heavy mobile equipment and vehicles against high-speed projectiles or fragments.

In U.S. Pat. No. 5,763,813 there is described a composite armor plate for absorbing and dissipating kinetic energy from high velocity, armor-piercing projectiles, said plate comprising a single internal layer of high density ceramic pellets which are directly bound and retained in plate form by a solidified material such that the pellets are bound in a plurality of superposed rows, characterized in that the pellets have an $Al_2O_3$ content of at least 85%, preferably at least 93%, and a specific gravity of at least 2.5, the majority of the pellets each have at least one axis in the range of about 3–12 mm, and are bound by said solidified material in a single internal layer of superposed rows, wherein a majority of each of said pellets is in direct contact with at least 4 adjacent pellets, the total weight of said plate does not exceed 45 kg/m$^2$ and said solidified material and said plate are elastic.

In U.S. patent application Ser. No. 09/048,628 (now U.S. Pat. No. 6,112,635) there is described and claimed a composite armor plate for absorbing and dissipating kinetic energy from high velocity, armor-piercing projectiles, said plate comprising a single internal layer of high density ceramic pellets which are directly bound and retained in plate by a solidified material such that the pellets are bound in a plurality of adjacent rows, characterized in that the pellets have an $Al_2O_3$ content of at least 93% and a specific gravity of at least 2.5, the majority of the pellets each have at least 12 mm length and are bound by said solidified material in a single internal layer of adjacent rows, wherein a majority of each of said pellets is in direct contact with at least 4 adjacent pellets, and said solidified material and said plate are elastic.

In U.S. Ser. No. 08/944,343 there is described and claimed a ceramic body for deployment in a composite armor panel, said body being substantially cylindrical in shape, with at least one convexly curved end face, wherein the ratio D/R between the diameter D of said cylindrical body and the radius R of curvature of said at least one convexly curved end face is at least 0.64:1.

The teachings of all three of these specifications is incorporated herein by reference.

There are four main considerations concerning protective armor panels. The first consideration is weight. Protective armor for heavy but mobile military equipment, such as tanks and large ships, is known. Such armor usually comprises a thick layer of alloy steel, which is intended to provide protection against heavy and explosive projectiles. However, reduction of weight of armor, even in heavy equipment, is an advantage since it reduces the strain on all the components of the vehicle. Furthermore, such armor is quite unsuitable for light vehicles such as automobiles, jeeps, light boats, or aircraft, whose performance is compromised by steel panels having a thickness of more than a few millimeters, since each millimeter of steel adds a weight factor of 7.8 kg/m$^2$.

Armor for light vehicles is expected to prevent penetration of bullets of any type, even when impacting at a speed in the range of 700 to 1000 meters per second. However, due to weight constraints it is difficult to protect light vehicles from high caliber armor-piercing projectiles, e.g. of 12.7 and 14.5 mm, since the weight of standard armor to withstand such projectile is such as to impede the mobility and performance of such vehicles.

A second consideration is cost. Overly complex armor arrangements, particularly those depending entirely on synthetic fibers, can be responsible for a notable proportion of the total vehicle cost, and can make its manufacture non-profitable.

A third consideration in armor design is compactness. A thick armor panel, including air spaces between its various layers, increases the target profile of the vehicle. In the case of civilian retrofitted armored automobiles which are outfitted with internal armor, there is simply no room for a thick panel in most of the areas requiring protection.

A fourth consideration relates to ceramic plates used for personal and light vehicle armor, which plates have been found to be vulnerable to damage from mechanical impacts caused by rocks, falls, etc.

Fairly recent examples of armor systems are described in U.S. Pat. No. 4,836,084, disclosing an armor plate composite including a supporting plate consisting of an open honeycomb structure of aluminium; and U.S. Pat. No. 4,868,040, disclosing an antiballistic composite armor including a shock-absorbing layer. Also of interest is U.S. Pat. No. 4,529,640, disclosing spaced armor including a hexagonal honeycomb core member.

Other armor plate panels are disclosed in British Patents 1,081,464; 1,352,418; 2,272,272, and in U.S. Pat. No. 4,061,815 wherein the use of sintered refractory material, as well as the use of ceramic materials, are described.

Ceramic materials are nonmetallic, inorganic solids having a crystalline or glassy structure, and have many useful physical properties, including resistance to heat, abrasion and compression, high rigidity, low weight in comparison with steel, and outstanding chemical stability. Such properties have long drawn the attention of armor designers, and solid ceramic plates, in thicknesses ranging from 7 mm. for personal protection to 30 mm. for heavy military vehicles, are commercially available for such use.

Much research has been devoted to improving the low tensile and low flexible strength and poor fracture toughness of ceramic materials; however, these remain the major drawbacks to the use of ceramic plates and other large components which can crack and/or shatter in response to the shock of an incoming projectile.

Light-weight, flexible armored articles of clothing have also been used for many decades, for personal protection against fire-arm projectiles and projectile splinters. Examples of this type of armor are found in U.S. Pat. No. 4,090,005. Such clothing is certainly valuable against low-energy projectiles, such as those fired from a distance of several hundred meters, but fails to protect the wearer against high-velocity projectiles originating at closer range and especially does not protect against armor-piercing projectiles. If made to provide such protection, the weight and/or cost of such clothing discourages its use. A further known problem with such clothing is that even when it succeeds in stopping a projectile the user may suffer injury due to indentation of the vest into the body, caused by too small a body area being impacted and required to absorb the energy of a bullet.

A common problem with prior art ceramic armor concerns damage inflicted on the armor structure by a first projectile, whether stopped or penetrating. Such damage weakens the armor panel, and so allows penetration of a following projectile, impacting within a few centimeters of the first.

The present invention is therefore intended to obviate the disadvantages of prior art ceramic armor, and in a first embodiment to provide an armor plate which is effective against small-caliber fire-arm projectiles, yet is of light weight, i.e, having a weight of less than 45 kg/m$^2$ (which is equivalent to about 9 lbs/ft ) and low bulk.

In other embodiments the present invention provides an armor plate which is effective against a full range of armor-piercing projectiles from 5.56 mm and even up to 30 mm, as well as from normal small-caliber fire-arm projectiles, yet is of light weight, i.e., having a weight of less than 185 kg/m$^2$, even for the heavier armor provided for dealing with 25 and 30 mm projectiles.

A further object of the invention is to provide an armor plate or panel which is particularly effective in arresting a plurality of armor-piercing projectiles impacting upon the same general area of the panel.

The armor plates described in U.S. Pat. No. 5,763,813 and U.S. application No. 09/048,628 are made using ceramic pellets made substantially entirely of aluminum oxide. In U.S. application 08/944,343 the ceramic bodies are of substantially cylindrical shape having at least one convexly-curved end-face, and are preferably made of aluminium oxide.

However, it has now been found that the improved properties of the plates described in the above patent applications is as much a function of the configuration of the pellets, which are of regular geometric form (for example, the pellets may be spherical or ovoidal, or of regular geometric cross-section, such as square, hexagonal, octagonal, or circular), said panels and their arrangement as a single internal layer of pellets bound by an elastic solidified material, wherein each of a majority of said pellets is in direct contact with at least four adjacent pellets in the same layer to provide mutual lateral confinement therebetween. As a result, composite armor plates superior to those available in the prior art can be manufactured using glass pellets which have a specific gravity of only 2, or pellets made of sintered refractory materials or ceramic materials having a specific gravity equal to or below that of aluminium oxide, e.g., boron carbide with a specific gravity of 2.45, silicon carbide with a specific gravity of 3.2 and silicon aluminum oxynitride with a specific gravity of about 3.2.

Thus, sintered oxides, nitrides, carbides and borides of magnesium, zirconium, tungsten, molybdium, titanium and silica can be used and especially preferred for use in the present invention are pellets selected from the group consisting of glass, boron carbide, titanium diboride, silicon carbide, magnesium oxide, silicon aluminum oxynitride in both its alpha and beta forms and mixtures thereof.

With increase in specific gravity the stopping power of the plates increases so that those plates utilizing pellets of higher specific gravity are also useful for absorbing and dissipating kinetic energy from high-velocity armor-piercing bullets.

Accordingly, the present invention provides a composite armor plate for absorbing and dissipating kinetic energy from high velocity projectiles, said plate comprising a single internal layer of pellets which are directly bound and retained in plate form by a solidified material such that the pellets are bound in a plurality of adjacent rows, characterized in that the pellets have a specific gravity of at least 2 and are made of a material selected from the group consisting of glass, sintered refractory material, ceramic material which does not contain aluminium oxide and ceramic material having an aluminium oxide content of not more than 80%, the majority of the pellets each have at least one axis of at least 3 mm length and are bound by said solidified material in said single internal layer of adjacent rows such that each of a majority of said pellets is in direct contact with at least 4 adjacent pellets in the same layer to provide mutual lateral confinement therebetween, said pellets each have a substantially regular geometric form and said solidified material and said plate are elastic.

In preferred embodiments of the present invention at least a majority of said pellets have at least one convexly-curved end face oriented to substantially face in the direction of an outer impact receiving major surface of said plate, although pellets with flat or even concavely-curved end faces can also be used even though the same have been found to be less effective.

In some preferred embodiments of the invention the majority of the pellets each have at least one axis having a length in the range of about 6–19 mm, and the total weight of said plate does not exceed 45 kg/m$^2$.

In other preferred embodiments of the invention the majority of said pellets each have at least one axis having a length in the range of from about 20 to 75 mm and the weight of said plate does not exceed 185 kg/m$^2$.

In especially preferred embodiments of the present invention, each of a majority of said pellets is in direct contact with at least six adjacent pellets.

In a first preferred embodiment of the present invention said pellets are spherical. In a second preferred embodiment of the invention said pellets each have a major axis and said pellets are arranged with their major axes substantially parallel to each other and oriented substantially perpendicularly relative to said outer impact-receiving major surface of said panel. The pellets need not be of circular cross-section.

The solidified material can be any suitable material which retains elasticity upon hardening at the thickness used, such as aluminium, epoxy, a thermoplastic polymer such as polycarbonate, or a thermoset plastic, thereby allowing curvature of the plate without cracking to match curved surfaces to be protected, including body surfaces, as well as elastic reaction of the plate to incoming projectiles to allow increased contact force between adjacent pellets at the point of impact.

In French Patent 2,711,782, there is described a steel panel reinforced with ceramic materials; however, due to the rigidity and lack of elasticity of the steel of said panel, said panel does not have the ability to deflect armor-piercing projectiles unless a thickness of about 8–9 mm of steel is used, which adds undesirable excessive weight to the panel and further backing is also necessary thereby further increasing the weight thereof.

It is further to be noted that the elasticity of the material used in preferred embodiments of the present invention serves, to a certain extent, to increase the probability that a projectile will simultaneously impact several pellets, thereby increasing the efficiency of the stopping power of the plate of the present invention.

According to a further aspect of the invention, there is provided a multi-layered armor panel, comprising an outer, impact-receiving layer formed by a composite armor plate as hereinbefore defined for deforming and shattering an impacting high velocity projectile; and an inner layer adjacent to said outer layer and, comprising an elastic material for absorbing the remaining kinetic energy from said fragments. Said elastic material will be chosen according to cost and weight considerations and can be made of any suitable material, such as aluminium, titanium or woven or non-woven textile material.

In especially preferred embodiments of the multi-layered armor panel, the inner layer adjacent to said outer layer comprises a tough woven textile material for causing an asymmetric deformation of the remaining fragments of said projectile and for absorbing the remaining kinetic energy from said fragments, said multi-layered panel being capable of stopping three projectiles fired sequentially at a triangular area of said multi-layered panel, wherein the height of said triangle is substantially equal to three times the length of the axis of said pellets.

As described, e.g., in U.S. Pat. No. 5,361,678, composite armor plate comprising a mass of spherical ceramic balls distributed in an aluminium alloy matrix is known in the prior art. However, such prior art composite armor plate suffers from one or more serious disadvantages, making it difficult to manufacture and less than entirely suitable for the purpose of defeating metal projectiles. More particularly, in the armor plate described in said patent, the ceramic balls are coated with a binder material containing ceramic particles, the coating having a thickness of between 0.76 and 1.5 and being provided to help protect the ceramic cores from damage due to thermal shock when pouring the molten matrix material during manufacture of the plate. However, the coating serves to separate the harder ceramic cores of the balls from each other, and will act to dampen the moment of energy which is transferred and hence shared between the balls in response to an impact from a bullet or other projectile. Because of this and also because the material of the coating is inherently less hard than that of the ceramic cores, the stopping power of a plate constructed as described in said patent is not as good, weight for weight, as that of a plate in accordance with the present invention, in which each of the pellets is in direct contact with at least four and preferably six adjacent pellets.

U.S. Pat. No. 3,705,558 discloses a lightweight armor plate comprising a layer of ceramic balls. The ceramic balls are in contact with each other and leave small gaps for entry of molten metal. In one embodiment, the ceramic balls are encased in a stainless steel wire screen; and in another embodiment, the composite armor is manufactured by adhering nickel-coated alumina spheres to an aluminium alloy plate by means of a polysulfide adhesive. A composite armor plate as described in this patent is difficult to manufacture because the ceramic spheres may be damaged by thermal shock arising from molten metal contact. The ceramic spheres are also sometimes displaced during casting of molten metal into interstices between the spheres.

In order to minimize such displacement, U.S. Pat. Nos. 4,534,266 and 4,945,814 propose a network of interlinked metal shells to encase ceramic inserts during casting of molten metal. After the metal solidifies, the metal shells are incorporated into the composite armor. It has been determined, however, that such a network of interlinked metal shells substantially increases the overall weight of the armored panel and decreases the stopping power thereof.

It is further to be noted that U.S. Pat. No. 3,705,558 suggests and teaches an array of ceramic balls disposed in contacting pyramidal relationship, which arrangement also substantially increases the overall weight of the armored panel and decreases the stopping power thereof, due to a billiard-like effect upon impact.

In U.S. Pat. Nos. 3,523,057 and 5,134,725 there are described further armored panels incorporating ceramic and glass balls; however, said panels are flexible and it has been found that the flexibility of said panels substantially reduces their stopping strength upon impact, since the force of impact itself causes a flexing of said panels and a reduction of the supporting effect of adjacent constituent bodies on the impacted constituent body, due to the arrangement thereof in said patent. Thus, it will be noted that the teachings of U.S. Pat. No. 5,134,725 is limited to an armor plate having a plurality of constituent bodies of glass or ceramic material which are arranged in at least two superimposed layers, which arrangement is similar to that seen in U.S. Pat. No. 3,705,558. In addition, reference to FIGS. 3 and 4 of said patent show that pellets of a first layer do not contact pellets of the same layer and are only in contact with pellets of an adjacent layer and therefore do not benefit from the support of adjacent pellets in the same layer to provide mutual lateral confinement of the pellets, as taught in the present invention.

As will be realized, none of said prior art patents teaches or suggests the surprising and unexpected stopping power of a single layer of ceramic or glass pellets in direct contact with each other which, as will be shown hereinafter, successfully prevents penetration of fire-arm projectiles despite the relative light weight of the plate incorporating said pellets.

Thus, it has been found that the novel armor of the present invention traps incoming projectiles between several pellets which are held in a single layer in mutual abutting and laterally-confining relationship. The relatively moderate size of the pellets ensures that the damage caused by a first projectile is localized and does not spread to adjoining areas, as in the case of ceramic plates.

A major advantage of the novel approach provided by the present invention is that it enables the fabrication of different plates and panels adapted to deal with different challenges, wherein e.g. smaller glass, sintered refractory or ceramic pellets can be used for personal armor and for meeting the challenge of 5.56, 7.62 and 9 mm projectiles, while larger ceramic pellets can be used to deal with foreseen challenges presented by 14.5 mm, 25 mm and even 30 mm armor piercing projectiles.

Thus it was found that cylindrical pellets having a diameter of 9.5 mm and a height of between 9.5 and 11.6 mm, as well as cylindrical pellets having a diameter of 12.7 mm and a height of between 9.5 and 11.6 mm were more than adequate to deal with projectiles of between 5.56 and 9 mm, when arranged in a plate according to the present invention.

Similarly and as demonstrated hereinafter, spherical glass pellets having a diameter of 10 mm were more than adequate to deal with multi-impacts of soft metal component 5.56 and 7.62 mm projectiles.

For heavy armored vehicles ceramic pellets having a diameter of 38 mm and a height of between 32 and 75 mm were found to be more than adequate to deal with 20, 25 and even 30 mm armor piercing projectiles when used in a multi-layered armor panel according to the present invention.

An incoming projectile may contact the pellet array in one of three ways:

1. Center contact. The impact allows the full volume of the pellet to participate in stopping the projectile, which cannot penetrate without pulverizing the whole pellet, an energy-intensive task. The pellets used are either spheres or other regular geometric shapes having at least one convexly-curved end face, said end face being oriented to substantially face in the direction of an outer impact receiving major surface of said plate and this form, when supported in a matrix of pellets, as shown, e.g. in the figures attached hereto, has been found to be significantly better at resisting shattering than other pellet arrangements suggested in the prior art.

2. Flank contact. The impact causes projectile yaw and shattering, thus making projectile arrest easier, as a larger frontal area is contacted, and not only the sharp nose of the projectile. The projectile is deflected sideways and needs to form for itself a large aperture to penetrate, thus allowing the armor to absorb the projectile energy.
3. Valley contact. The projectile is jammed, usually between the flanks of three pellets, all of which participate in projectile arrest. The high side forces applied to the pellets are resisted by the pellets adjacent thereto as held by the matrix, and penetration is prevented.

An additional preferred embodiment according to the present invention is one wherein the ceramic material is SiAlON in its alpha structure of $Si_{6-z}Al_zO_zN_{8-z}$, in which "z" is a substitution coefficient of Al and O in the $Si_3N_4$ and the "beta structure" of the formula $Me_{m/val}Si_{12-(m-n)}Al_{m+n}O_nN_{16-n}$, wherein Me is a metal such as Li, Mg, Ca, Y, and lanthanide's, m and n are substitution coefficients and val is the valency of the metal.

The invention will now be described in connection with certain preferred embodiments with reference to the following illustrative figures so that it may be more fully understood.

With reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 1:
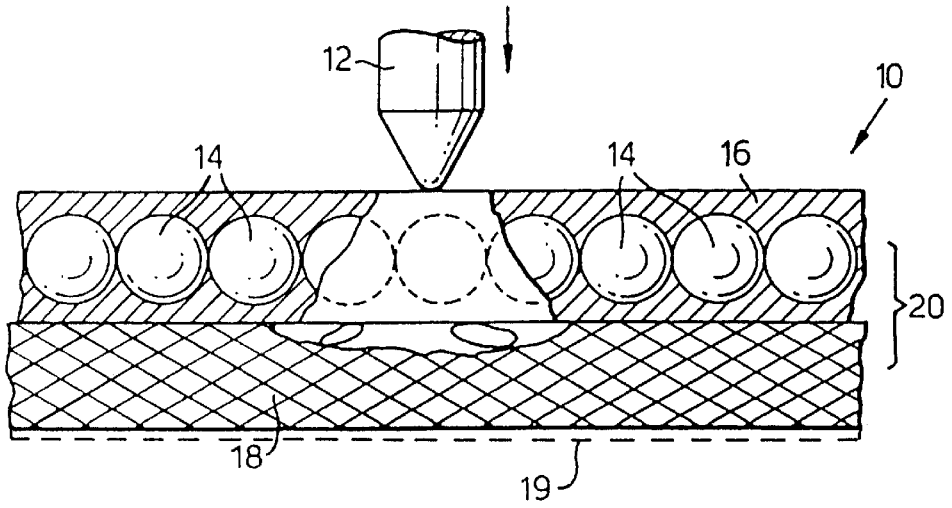
FIG. 1 is a cross-sectional side view of a first preferred embodiment of a two-layered armor panel according to the invention.
Figure 2:
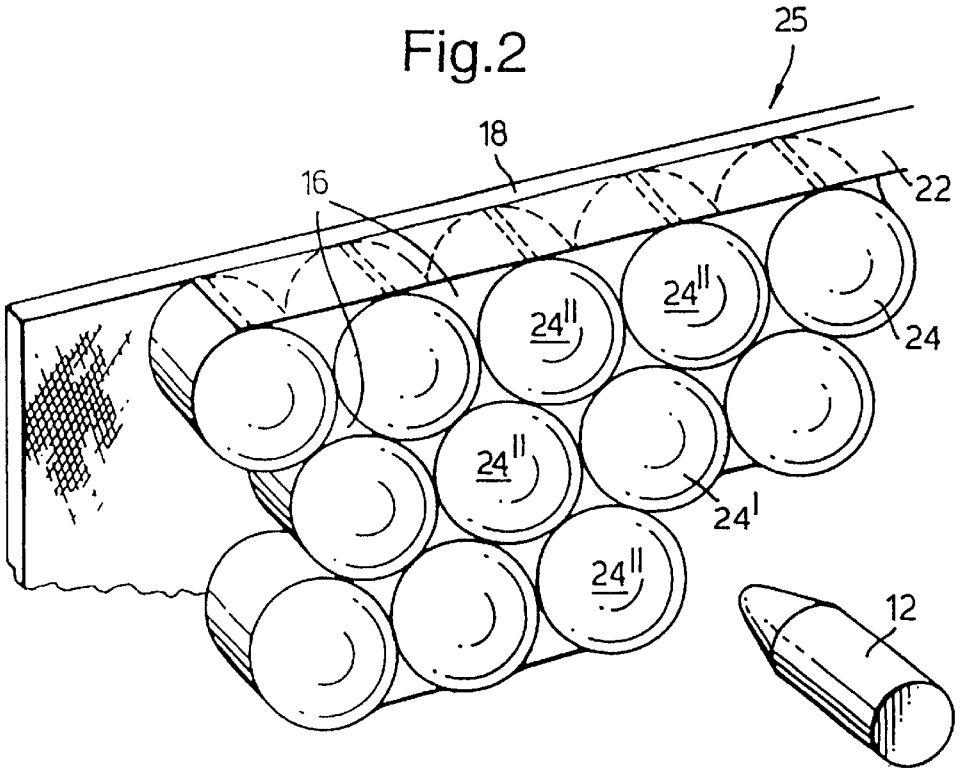
FIGS. 2 is a perspective view of a small section of a second preferred embodiment of an armor panel according to the invention.

There is seen in FIG. 1 a composite armor plate 10 for absorbing and dissipating kinetic energy from the fire-arm projectiles 12, said plate comprising a single internal layer of spherical glass pellets 14, said pellets being arranged in a single layer of adjacent rows, wherein each of a majority of said pellets is in direct contact with at least 4 adjacent pellets(as better seen with regard to the pellets shown in FIG. 2). As seen, the entire array of pellets is bound in said single layer of a plurality of adjacent rows by solidified epoxy 16 and said plate 10 is further provided with an inner backing layer 18 made of polyethylene fibers sold under the trademar of DYNEEMA® or of similar material, to form a multi-layered armored panel 20.

There is seen in FIG. 2 a composite armor plate 22 for absorbing and dissipating kinetic energy from fire-arm projectiles 12, said plate comprising a single internal layer of glass pellets 24 which are substantially cylindrical with at least one convexly-curved end face, said pellets being arranged in a single layer of adjacent rows wherein each of a majority of said pellets 24'is in direct contact with at least 4 adjacent pellets 24". As shown, the entire array of pellets is bound in said single layer of a plurality of adjacent rows by solidified epoxy 16, and said plate 22 is further provided with an inner backing layer 18 made of DYNEEMA® or of similar textile material such a backing made of polycarbonate or a tough, light aramid synthetic fiber sold under the trademark KEVLAR®, to form a multi-layered armored panel 26.

The nature of the solidified material 16 is selected in accordance with the weight, performance and cost considerations applicable to the intended use of the armor.

Armor for land and sea vehicles is suitably made using a metal casting alloy containing at least 80% aluminium. A suitable alloy is Aluminium Association No. 535.0, which combines a high tensile strength of 35,000 kg/in$^2$ with excellent ductility, having 9% elongation. Further suitable alloys are of the type containing 5% silicon B443.0. These alloys are easy to cast in thin sections; their poor machinability is of little concern in the application of the present invention. An epoxy or other plastic or polymeric material, advantageously fiber-reinforced, is also suitable.

Tables 1 and 2 are reproductions of test reports relating to epoxy-bound multi-layer panels as described above with reference to FIG. 1. Each of the panels had dimensions of 14"×14"and had a backing layer 18 made of DYNEEMA® 10 mm thick.

The first panel was impacted by a series of three soft-nosed component 7.62 mm projectiles fired at 0° elevation and at a distance of 50 ft. from the target.

None of the 3 projectiles penetrated the panel.

The second panel was impacted by a series of six soft-nosed component 5.56 mm projectiles, also fired at 0 elevation and at a distance of 50 ft. from the target.

None of the 6 projectiles penetrated the panel.

TABLE 1

| | | |
|---|---|---|
| Date Rec'd: 04-27-98<br>via: HAND CARRIED<br>Returned: HAND CARRIED<br>File (HPWLI): RD-1.PIN<br>TEST PANEL | H. P. WHITE LABORATORY, INC.<br>DATA RECORD<br>-BALLISTIC RESISTANCE TESTS- | Job. No.: 7592-02<br>Test Date: 04-27-98<br>Customer: R & D ETZION |
| Description: PROPRIETARY<br>Manufacturer: R & D ETZION<br>Size: PT. 10 × 12, VT. 14 × 14 in.<br>Thicknesses: na<br>Avg. Thick.: na<br>AMMUNITION | | Sample No.: 12<br>Weight: PT. 5.18, VT. 1.97 lbs.<br>Hardness: na<br>Plies/Laminates: NA |
| (1): 7.62 × 51 mm M80 BALL 149.0 gr | | Lot. No.: WINCHESTER WCC90B001-001 |

TABLE 1-continued

| | |
|---|---|
| (2): | Lot No.: |
| (3): | Lot No.: |
| (4): | Lot No.: |
| SET-UP | |
| Vel. Screens: 6.5 ft. & 9.5 ft. | Range to Target: 50.0 ft. |
| Shot Spacing: PER CUSTOMER REQUEST | Range Number: 1 |
| Barrel No./Gun: 062 | Backing Material: 5.5" CLAY/PLYWOOD |
| Obliquity: 0 deg. | Target to Wit.: 0.0 in. |
| Witness Panel: CLAY | Conditioning: DRY @ 71 DEG. F. |
| APPLICABLE STANDARDS OR PROCEDURES | |
| (1): PER CUSTOMER REQUEST | |
| (2): | |
| (3): | |

| Shot No. | Ammo. | Time s × $10^{-5}$ | Velocity ft/s | Time s × $10^{-5}$ | Velocity ft/s | Avg. Vel. ft/s | Penetration | Footnotes |
|---|---|---|---|---|---|---|---|---|
| 1 | | | | | | | None | DEF. 42 × 82 mm |
| 2 | | | | | | | None | DEF. 43 × 86 mm |
| 3 | | | | | | | None | DEF. 37 × 83 mm |

FOOTNOTES:

REMARKS:
Local BP = 30.06 in. Hg, Temp. = 71.0 F., RH = 42%

TABLE 2

| | | |
|---|---|---|
| Date Rec'd: 04-27-98 | H. P. WHITE LABORATORY, INC. | Job. No.: 7592-02 |
| via: HAND CARRIED | DATA RECORD | Test Date: 04-27-98 |
| Returned: HAND CARRIED | -BALLISTIC RESISTANCE TESTS- | Customer: R & D ETZION |
| File (HPWLI): RD-15.PIN | | |
| TEST PANEL | | |
| Description: PROPRIETARY | | |
| Manufacturer: R & D ETZION | | Sample No.: 8 |
| Size: PT. 10 × 12, VT. 14 × 14 in. | | Weight: PT. 7.20, VT. 1.94 lbs. |
| Thicknesses: na | | Hardness: na |
| Avg. Thick.: na | | Plies/Laminates: NA |
| AMMUNITION | | |
| (1): 5.56 × 45 mm M855 BALL 62.0 gr | | Lot. No.: FNB83G001L002 |
| (2): | | Lot No.: |
| (3): | | Lot No.: |
| (4): | | Lot No.: |
| SET-UP | | |
| Vel. Screens: 6.5 ft. & 9.5 ft. | | Range to Target: 50.0 ft. |
| Shot Spacing: PER CUSTOMER REQUEST | | Range Number: 1 |
| Barrel No./Gun: 038 | | Backing Material: 5.5" CLAY/PLYWOOD |
| Obliquity: 0 deg. | | Target to Wit.: 0.0 in. |
| Witness Panel: CLAY | | Conditioning: DRY @ 68 DEG. F. |
| APPLICABLE STANDARDS OR PROCEDURES | | |
| (1): PER CUSTOMER REQUEST | | |
| (2): | | |
| (3): | | |

| Shot No. | Ammo. | Time s × $10^{-5}$ | Velocity ft/s | Time s × $10^{-5}$ | Velocity ft/s | Avg. Vel. ft/s | Penetration | Footnotes |
|---|---|---|---|---|---|---|---|---|
| 1 | | | | | | | None | DEF. 12 × 65 mm |
| 2 | | | | | | | None | DEF. 14 × 61 mm |
| 3 | | | | | | | None | DEF. 12 × 55 mm |
| 4 | | | | | | | None | DEF. 10 × 54 mm |
| 5 | | | | | | | None | DEF. 13 × 62 mm |
| 6 | | | | | | | None | DEF. 14 × 61 mm |

FOOTNOTES:

REMARKS:
Local BP = 30.32 in. Hg, Temp. = 68.0 F., RH = 48%

As will be noted, spherical glass pellets, when arranged in a single layer according to the present invention, enable the preparation of a composite armor plate which can withstand multiple impacts in a relatively small area, which multi-impact protection was not available with prior art amour of comparable weight.

A plurality of ceramic bodies of substantially cylindrical shape and having one convexly-curved end face, wherein all of said bodies are of equal size and shape, each having a height H of 7.5 mm, a diameter D. Of 12.8 mm and a radius of curvature R, respectively of 20 mm, 15 mm, 10 mm, 9.5 mm and 9 mm were prepared from aluminum oxide, SiAION, silicon carbide and boron carbide and were placed sequentially in a hydraulic press Model M.50/1 manufactured by Taamal Mizra, Kibbutz Mizra, Israel, incorporating a C-57-G piston, and capable of generating 50 tons of pressure and the shattering points of each body was recorded as follows:

TABLE 3

| | $Al_2O_3$ alumina | SiAlON | Silicon Carbide (SiC) | Boron Carbide ($B_4C$) |
|---|---|---|---|---|
| 20 mm R body | 5 | 5.9 | 5.9 | 6.4 |
| 15 mm R body | 6 | 7.1 | 7.1 | 7.7 |
| 10 mm R body | 7.3 | 8.6 | 8.6 | 9.4 |
| 9.5 mm R body | 7.4 | 8.7 | 8.7 | 9.5 |
| 9 mm R body | 7.5 | 8.8 | 8.8 | 9.6 |

Considering that SiAION is lighter in weight than aluminum oxide and has a surprisingly greater shattering strength, it is ideally suited for use in the composite armor plates of the present invention.

It will be evident to those skilled in the art that the invention is not limited to the details of the foregoing illustrated embodiments and that the present invention may be embodied in other specific forms without departing from the scope of the invention as defined by the appended claims.

What is claimed is:

1. A composite armor plate for absorbing and dissipating kinetic energy from high velocity projectiles, said plate comprising a single internal layer of pellets which are directly bound and retained in plate form by a solidified material such that the pellets are bound in a plurality of adjacent rows, characterized in that the pellets have a specific gravity of at lest 2 and are made of a material selected from the group consisting of glass, sintered refractory material, ceramic material which does not contain aluminum oxide and ceramic material having an aluminium oxide content of not more than 80%, the majority of the pellets each have at least one axis of at least 3 mm length and are bound by said solidified material in said single internal layer of adjacent rows such that each of a majority of said pellets is in direct contact with at least 6 adjacent pellets in the same layer to provide mutual lateral confinement therebetween, said pellets each have a substantially regular geometric form and said solidified material and said plate are elastic.

2. A composite armor plate according to claim 1, wherein the majority of said pellets each have at least one axis having a length in the range of from 6 to 19 mm, and the weight of said plate does not exceed 45 kg/m$^2$.

3. A composite armor plate as claimed in claim 1 for absorbing and dissipating kinetic energy from high velocity armor piercing projectiles, wherein said pellets are made of a ceramic material selected from the group consisting of boron carbide, titanium diboride, silicon carbide, magnesium oxide, silicon aluminum oxynitride and mixtures thereof.

4. A composite armor plate according to claim 3, wherein the majority of said pellets each have at least one axis having a length in the range of from 20 to 75 mm, and the weight of said plate does not exceed 185 kg/m$^2$.

5. A composite armor plate as claimed in claim 4, wherein the majority of said pellets each has a major axis having a length in the range of from 20 to 30 mm.

6. A composite armor plate as claimed in claim 1, wherein said pellets have a hardness of at least 9 on the Mohs scale.

7. A composite armor plate as claimed in claim 1, wherein said pellets each have a major axis and said pellets are arranged with their major axes substantially parallel to each other and oriented substantially perpendicularly relative to said outer impact-receiving major surface of said panel.

8. A composite armor plate as claimed in claim 1, wherein said solidified material is a thermoplastic resin.

9. A composite armor plate as claimed in claim 1, wherein said solidifed material is epoxy.

10. A composite armor plate as claimed in claim 1, wherein said pellets are ceramic material made of silicon aluminum oxynitride.

11. A composite armor plate as claimed in claim 1, wherein a majority of said pellets have at least one convexly-curved end face oriented to substantially face in the direction of an outer impact receiving major surface of said plate.

12. A multi-layered armor panel, comprising:

an outer, impact-receiving layer formed by a composite armor plate according to claim 1 for deforming and shattering an impacting high velocity projectile; and an inner layer adjacent to said outer layer, said inner layer comprising a tough woven textile material for causing an asymmetric deformation of the remaining fragments of said projectile and for absorbing the remaining kinetic energy from said fragments, said multi-layered panel being capable of stopping three projectiles fire sequentially at a triangular area of said multi-layered panel, wherein the height of said triangle is substantially equal to three times the length of the axis of said pellets.

13. A multi-layered armor panel according to claim 12, wherein said inner layer is made of polyethylene fibers.

14. A multi-layered armor panel according to claim 12, wherein said inner layer is made of aramid synthetic fibers.

15. A multi-layered armor panel according to claim 12, wherein said inner layer comprises multiple layers of a polyamide netting.

16. A multi-layered armor panel according to claim 12, comprising a further backing layer of aluminium.

* * * * *